US010446971B2

(12) United States Patent
Cheng et al.

(10) Patent No.: US 10,446,971 B2
(45) Date of Patent: Oct. 15, 2019

(54) ELECTRICAL CONNECTOR ASSEMBLY WITH IMPROVED LOCKING DEVICE

(71) Applicant: FOXCONN INTERCONNECT TECHNOLOGY LIMITED, Grand Cayman (KY)

(72) Inventors: Chih-Pi Cheng, New Taipei (TW); Chao-Chieh Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 322 days.

(21) Appl. No.: 15/597,407

(22) Filed: May 17, 2017

(65) Prior Publication Data

US 2017/0338582 A1 Nov. 23, 2017

Related U.S. Application Data

(60) Provisional application No. 62/337,353, filed on May 17, 2016.

(51) Int. Cl.

| | |
|---|---|
| ***H01R 13/516*** | (2006.01) |
| ***H01R 13/631*** | (2006.01) |
| ***H01R 13/6596*** | (2011.01) |
| ***H01R 24/62*** | (2011.01) |
| ***H01R 13/627*** | (2006.01) |
| ***H01R 107/00*** | (2006.01) |
| ***H01R 13/639*** | (2006.01) |
| ***H01R 24/60*** | (2011.01) |

(52) U.S. Cl.

CPC ..... *H01R 13/516* (2013.01); *H01R 13/6275* (2013.01); *H01R 13/631* (2013.01); *H01R 13/6596* (2013.01); *H01R 24/62* (2013.01); *H01R 13/6392* (2013.01); *H01R 24/60* (2013.01); *H01R 2107/00* (2013.01)

(58) Field of Classification Search

CPC ..... H01R 13/516; H01R 13/6275; H01R 13/631; H01R 13/6596; H01R 13/6392; H01R 24/62; H01R 24/60; H01R 2107/00

See application file for complete search history.

(56) References Cited

U.S. PATENT DOCUMENTS

| | | | | |
|---|---|---|---|---|
| 9,525,227 | B2 * | 12/2016 | Little | H01R 13/6273 |
| 2006/0189199 | A1 * | 8/2006 | Lang | H01R 12/7005 439/374 |
| 2017/0338582 | A1 * | 11/2017 | Cheng | H01R 13/516 |

* cited by examiner

*Primary Examiner* — Abdullah A Riyami
*Assistant Examiner* — Nader J Alhawamdeh
(74) *Attorney, Agent, or Firm* — Wei Te Chung; Ming Chieh Chang

(57) ABSTRACT

According to one aspect of the present invention, an electrical connector assembly includes a locking station and a plug cable connector. Said locking station has a receiving cavity, and a pair of side walls extending in a front-to-back direction and locating at two sides of the receiving cavity in a transverse direction perpendicular to said front-to-back direction. Said plug cable connector is forwardly inserted into said receiving cavity and includes a spring being deflectable in a vertical direction perpendicular to both said front-to-back direction and said transverse direction. Said spring includes a pair of laterally extending offset ends; and each side wall defines a locking shoulder facing forwardly and pressing against said respective offset end downwardly.

14 Claims, 23 Drawing Sheets

ELECTRICAL CONNECTOR ASSEMBLY WITH IMPROVED LOCKING DEVICE

BACKGROUND OF THE INVENTION

1. Field of the Invention

The present invention relates to an electrical connector assembly, more particularly to an electrical connector assembly having a retaining device equipped with spring means to stably retain the plug cable connector to the receptacle connector.

2. Description of Related Art

The traditional receptacle connector is mated with the complementary plug cable connector with or without the corresponding locking means. Anyhow, it is further desired to have a reliably tensioned latching not only in a vertical direction but also in a front-to-back direction perpendicular to the vertical direction.

BRIEF SUMMARY OF THE INVENTION

According to one aspect of the present invention, an electrical connector assembly includes a locking station and a plug cable connector. Said locking station has a receiving cavity, and a pair of side walls extending in a front-to-back direction and locating at two sides of the receiving cavity in a transverse direction perpendicular to said front-to-back direction. Said plug cable connector is forwardly inserted into said receiving cavity and includes a spring being deflectable in a vertical direction perpendicular to both said front-to-back direction and said transverse direction. Said spring includes a pair of laterally extending offset ends; and each side wall defines a locking shoulder facing forwardly and pressing against said respective offset end downwardly.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
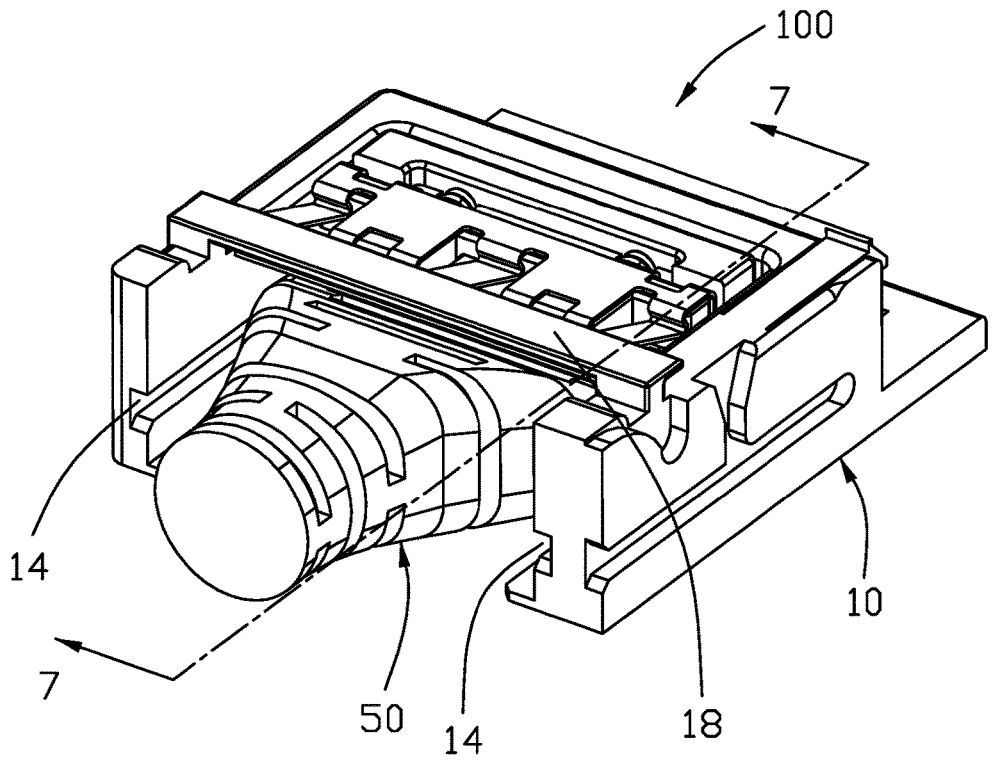
FIG. 1 is a perspective view of the electrical connector assembly in accordance with present invention wherein the plug cable connector is fully received and locked in the locking station.
Figure 2:
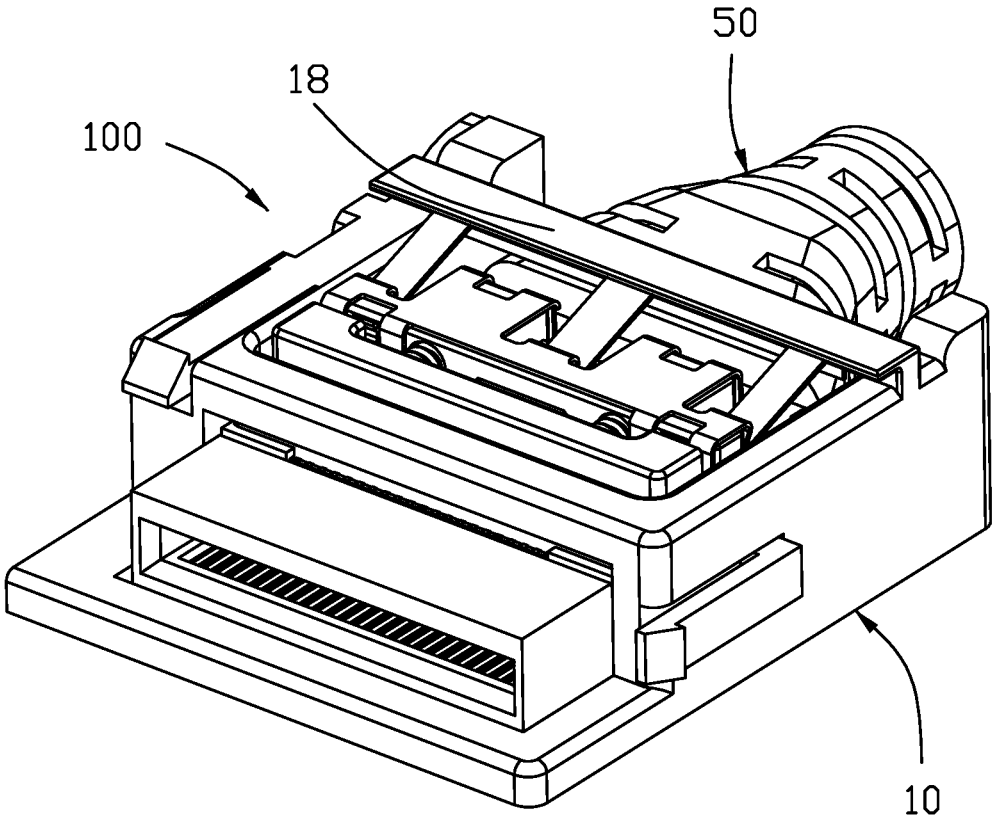
FIG. 2 is another perspective view of the electrical connector assembly of FIG. 1.
Figure 3:
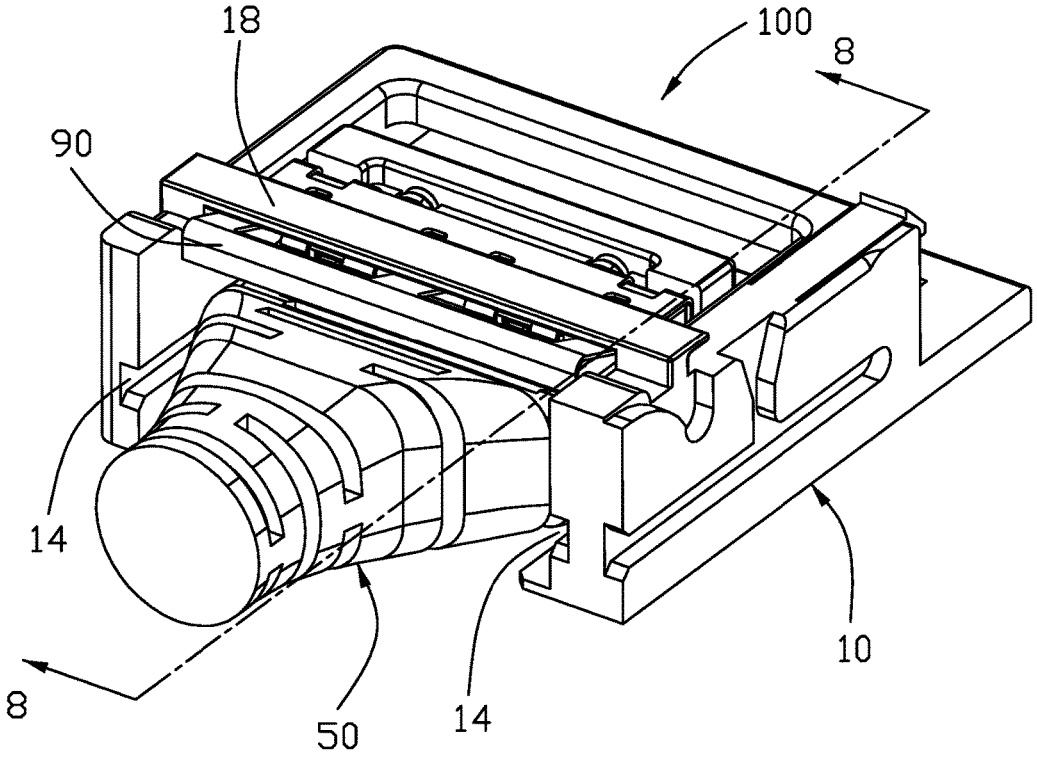
FIG. 3 is a perspective view of the electrical connector assembly wherein the plug cable connector is not fully inserted into the locking station.
Figure 4:
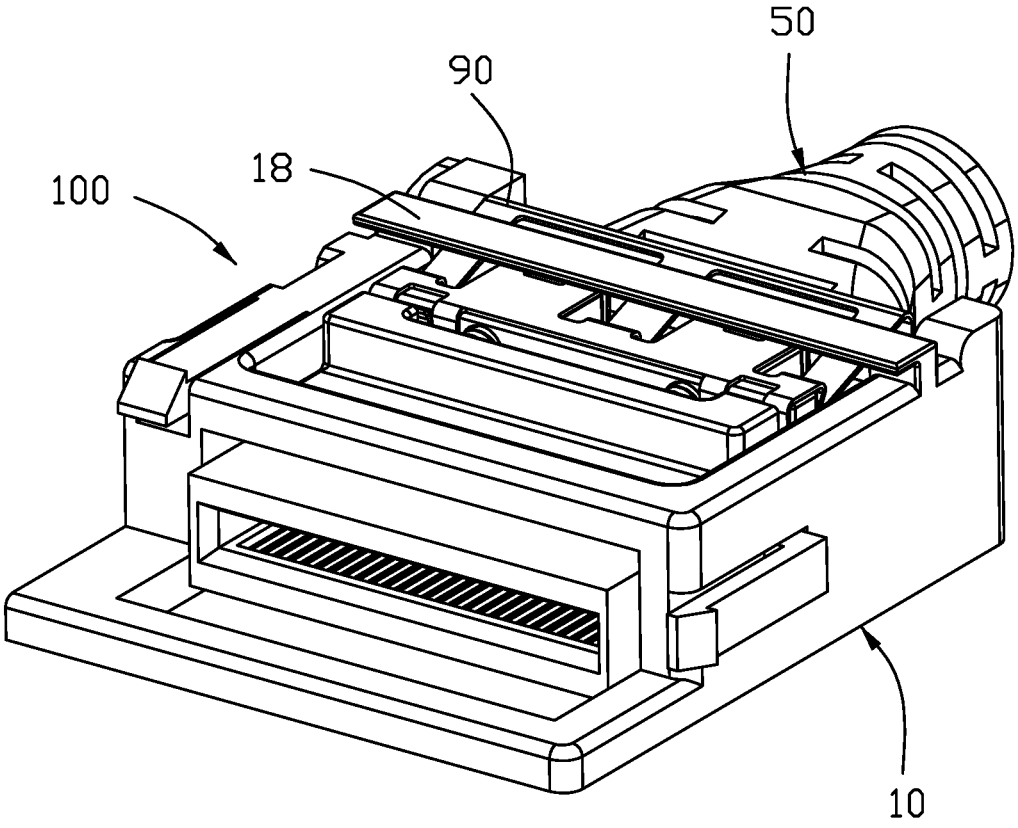
FIG. 4 is another perspective view of the electrical connector assembly of FIG. 3
Figure 5:
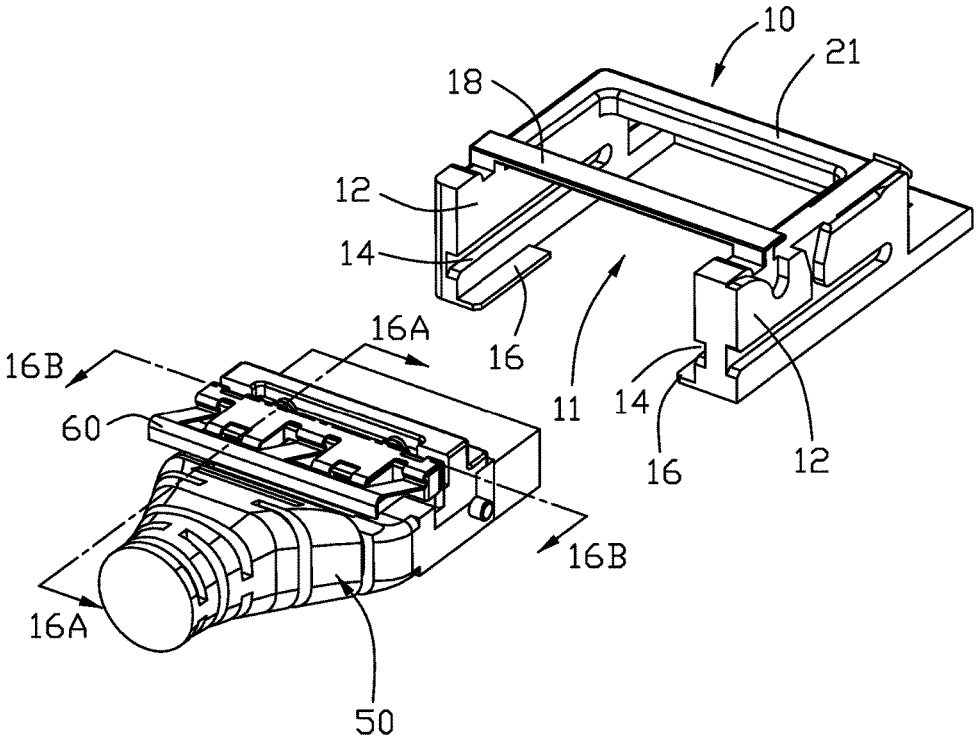
FIG. 5 is a further exploded perspective view of the electrical connector assembly of FIG. 3.
Figure 6:
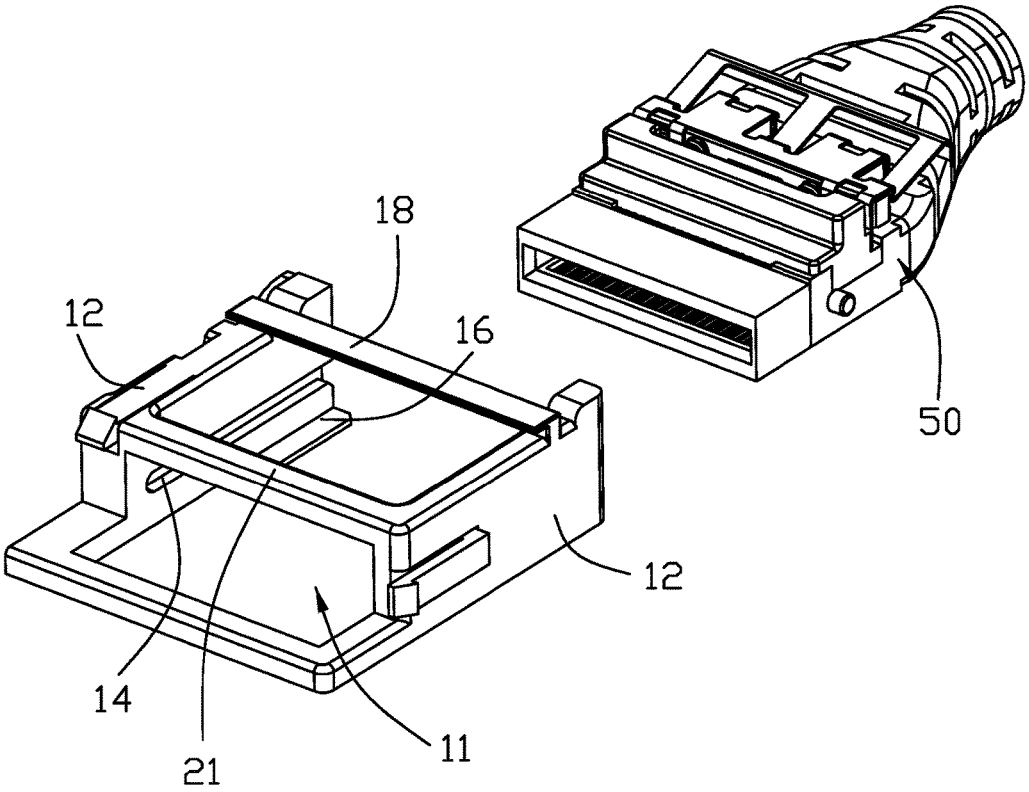
FIG. 6 is another further perspective view of the electrical connector assembly of FIG. 5.
Figure 7:
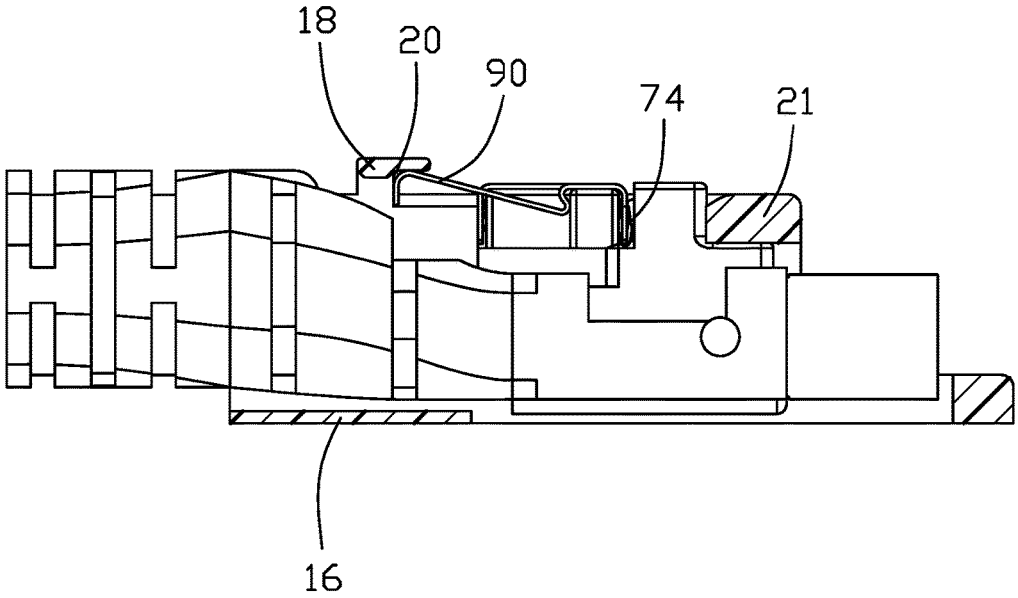
FIG. 7 is a cross-sectional view of the electrical connector assembly of FIG. 1 along line 7-7.
Figure 8:
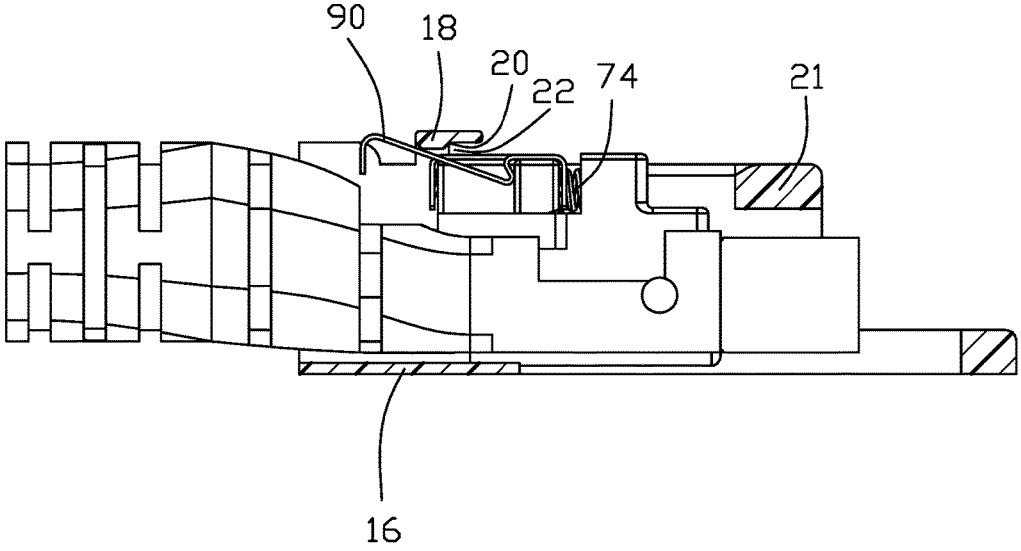
FIG. 8 is a cross-sectional view of the electrical connector assembly of FIG. 3 along line 8-8.
Figure 9:
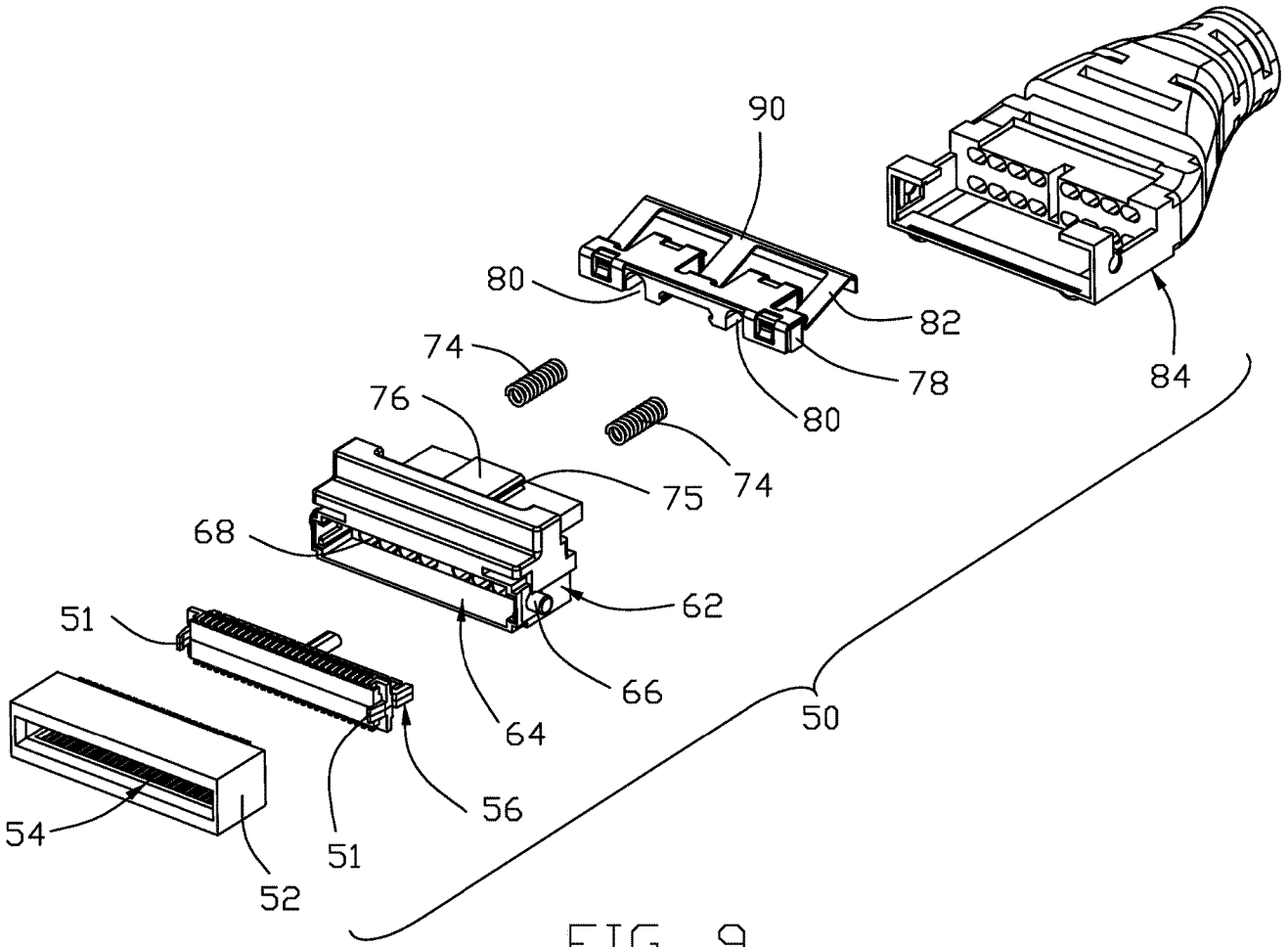
FIG. 9 is an exploded perspective view of the plug cable connector of the electrical connector assembly of FIG. 1.
Figure 10:
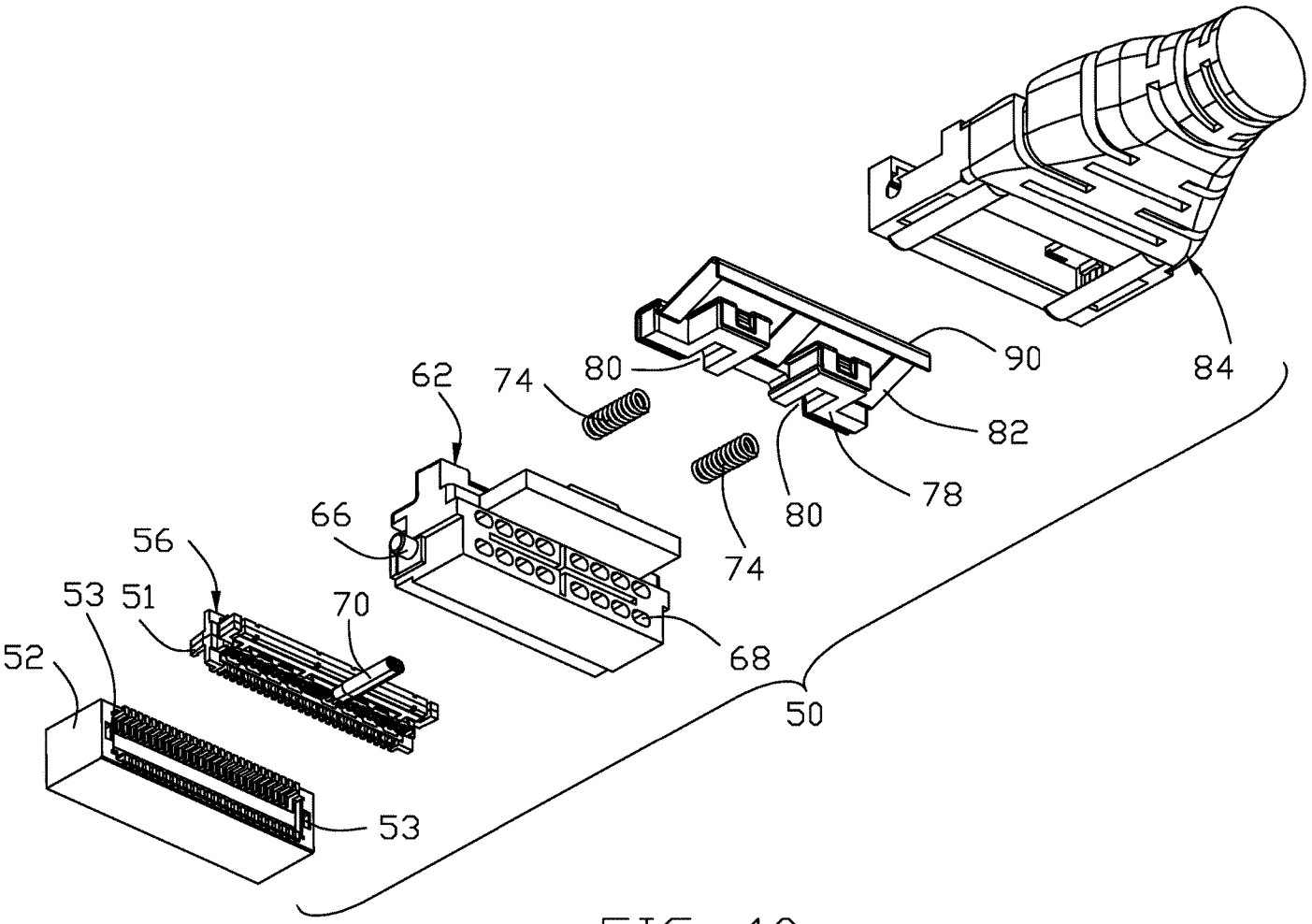
FIG. 10 is another exploded perspective view of the plug cable connector of FIG. 9.
Figure 11:
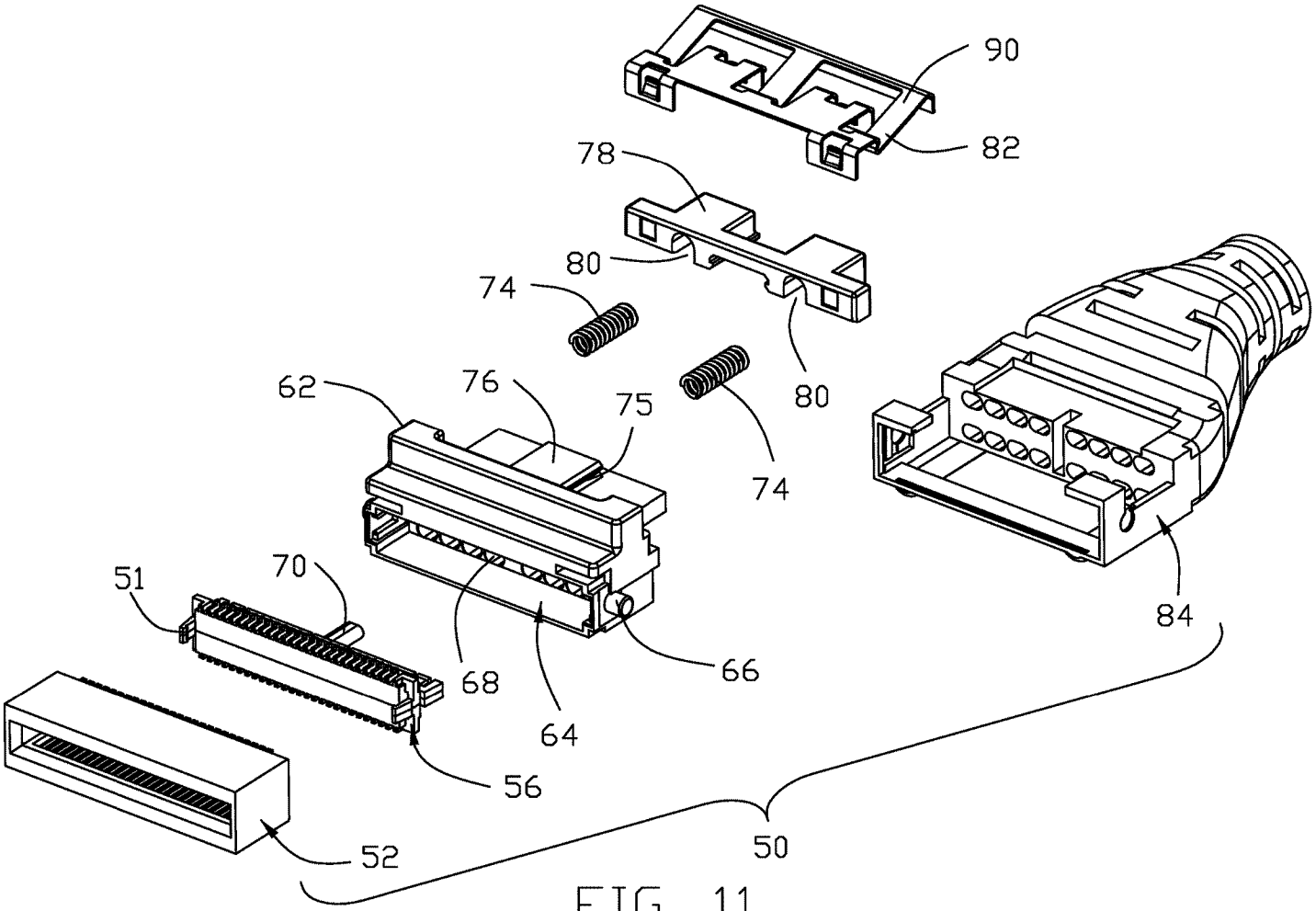
FIG. 11 is an further exploded perspective view of the plug cable connector of FIG. 9.
Figure 12:
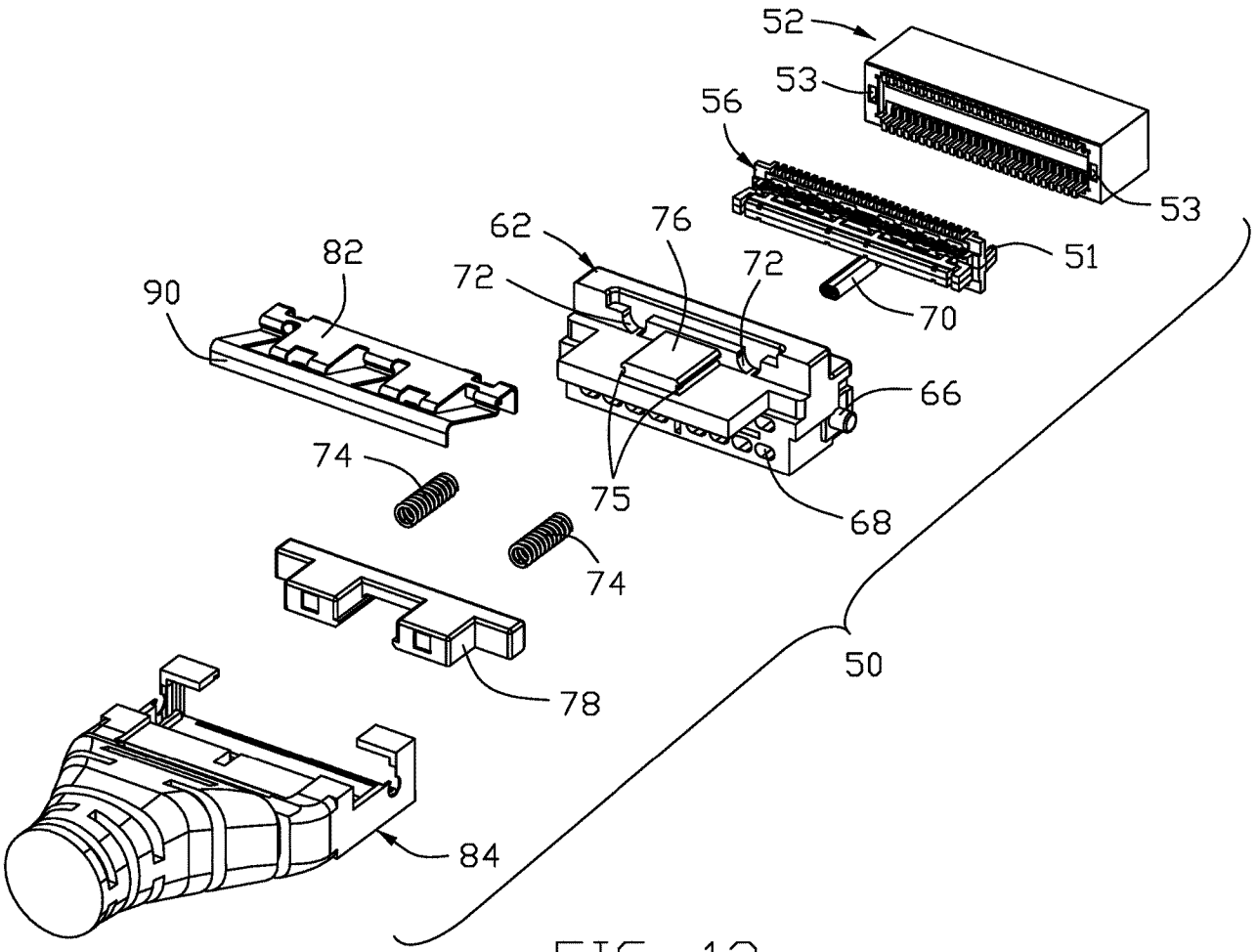
FIG. 12 is another further exploded perspective view of the plug connector of FIG. 11.
Figure 13:
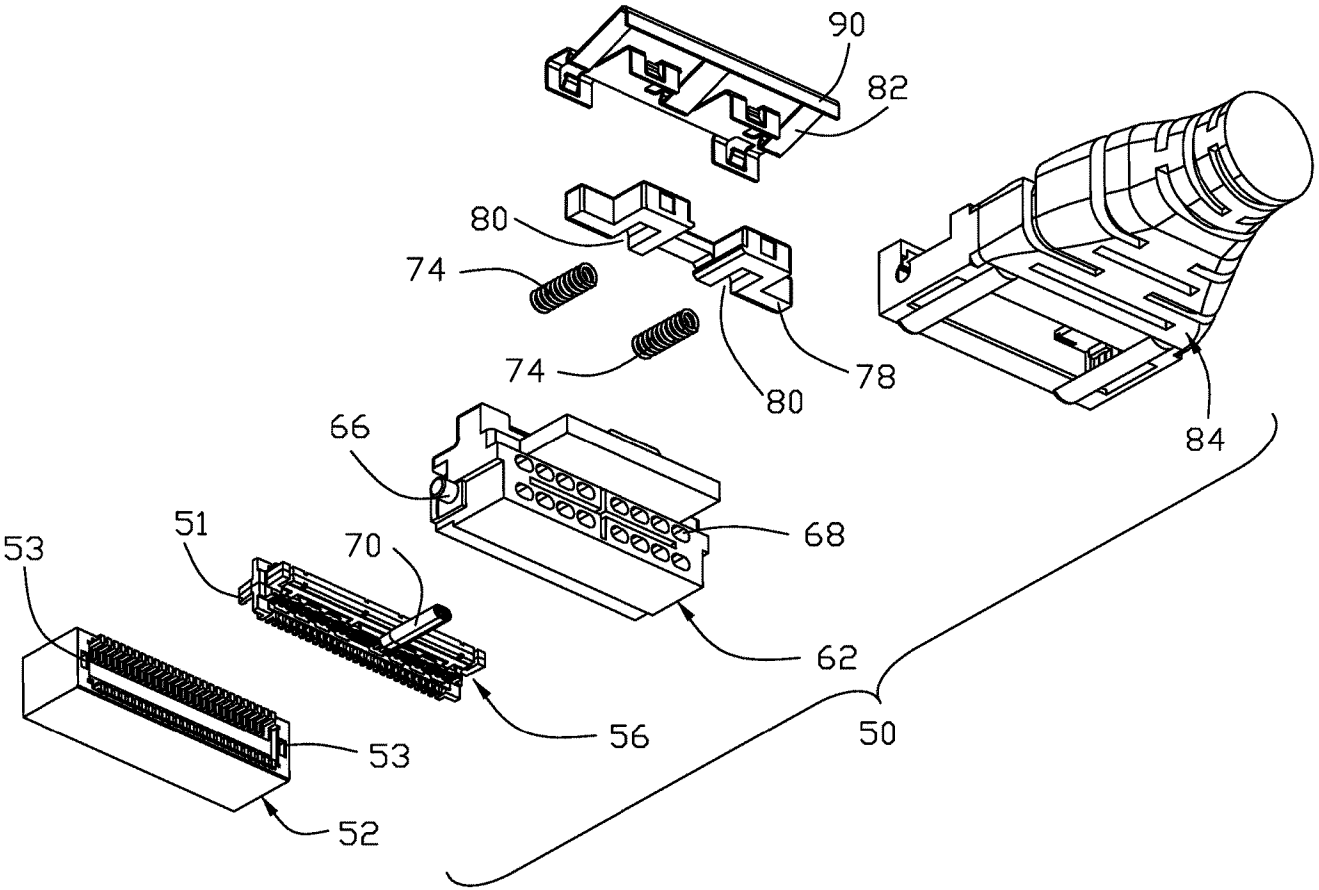
FIG. 13 is another further exploded perspective view of the plug cable connector of FIG. 11
Figure 14:
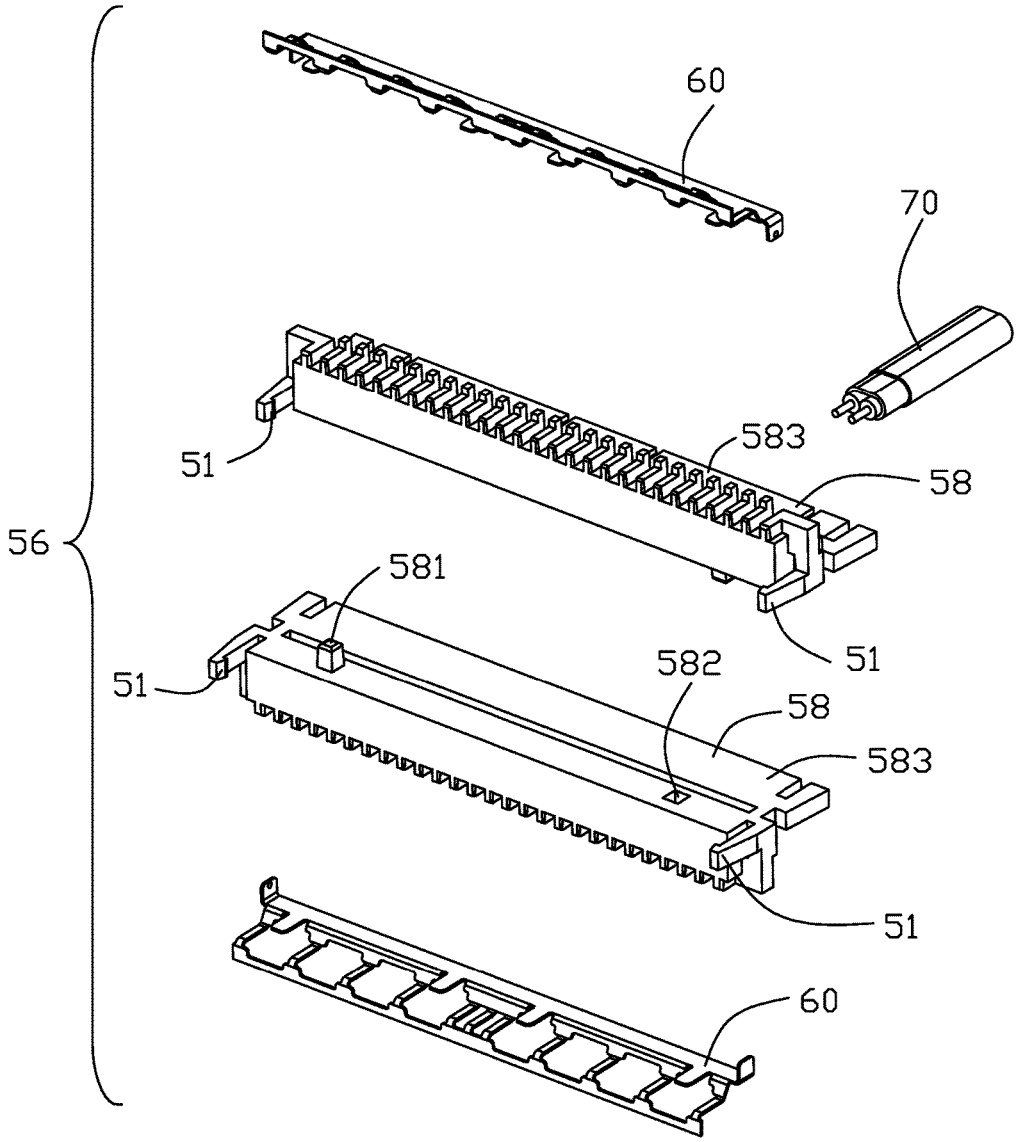
FIG. 14 is an exploded perspective view of the terminal module assembly of the plug cable connector of FIG. 11.
Figure 15:
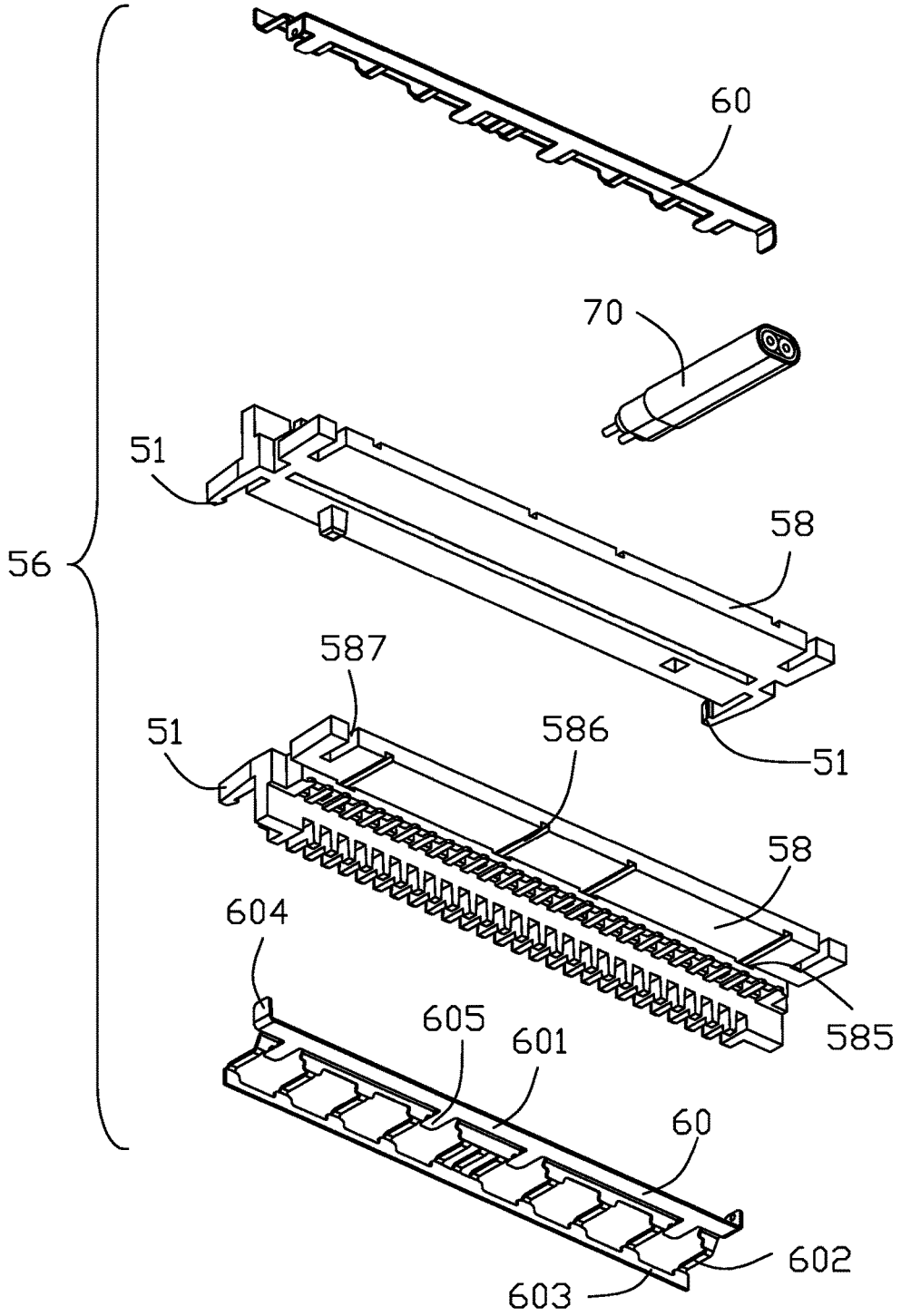
FIG. 15 is another exploded perspective view of the terminal module assembly of the plug cable connector of FIG. 14.
Figure 16A:
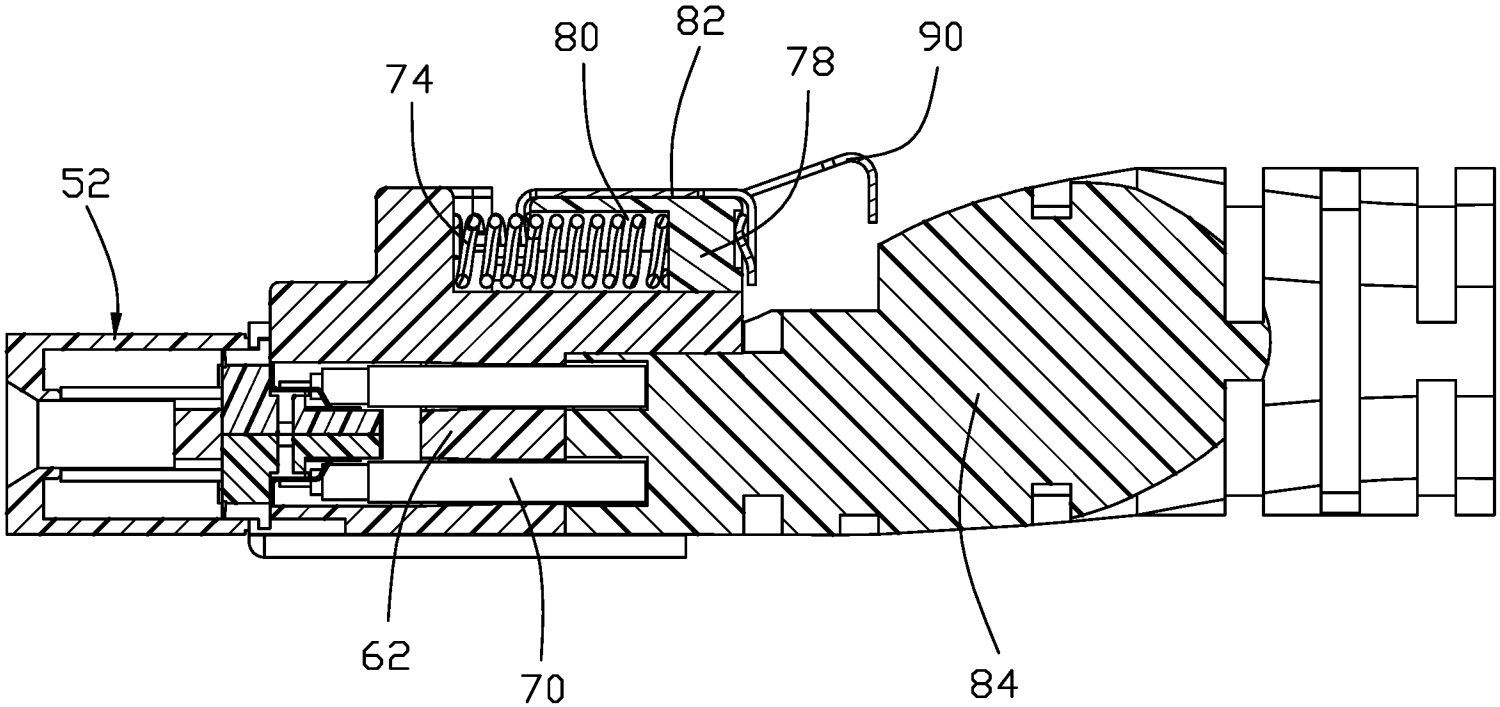
FIG. 16(A) is a cross-sectional view of the plug cable connector of FIG. 5 along line 16A-16A.
Figure 16B:
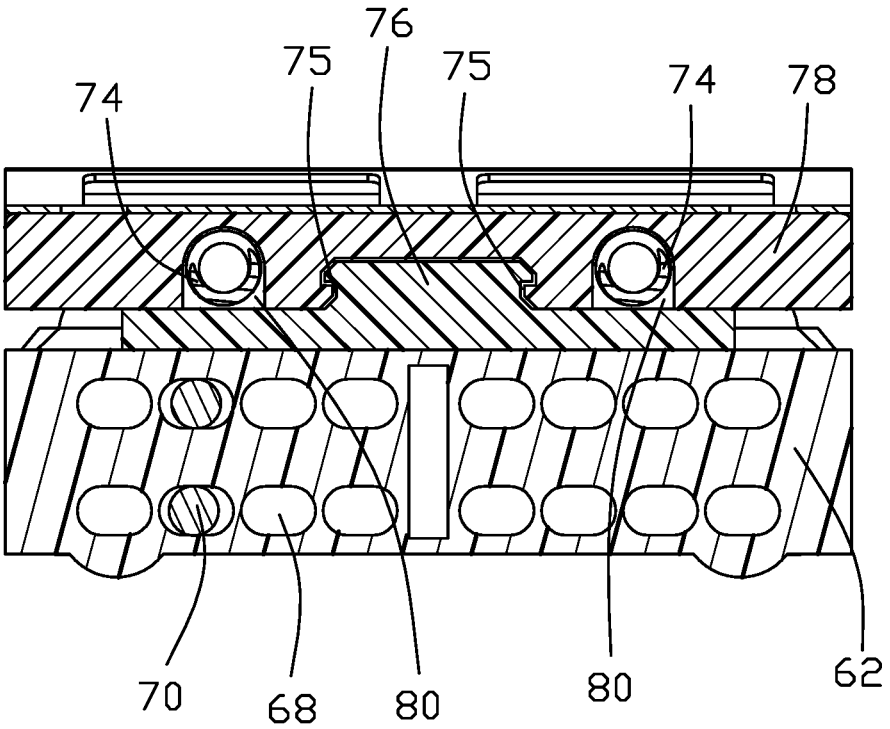
FIG. 16(B) is a cross-sectional view of the plug cable connector of FIG. 5 along line 16B-16B.

Referring to FIGS. 1-16(B), An electrical connector assembly 100 includes a locking station 10 forming a receiving cavity 11 to receive a plug cable connector 50. The locking station 10 including a pair of side walls 12, a pair of guiding grooves 14 formed in interior surfaces and extending along a front-to-back direction, and a pair of flanges 16 around a bottom edge of the side walls 12, respectively, so as to cooperate with a top bar 18 to commonly define the receiving cavityll. The top bar 18 forms a locking shoulder 20 on an underside for engagement with a locking latch 90 of the plug cable connector 50 (illustrated later), said locking shoulder 20 has a recess 22 formed on an underside thereof to receive the locking latch 90. Understandably, the locking shoulder 20 forms a forward abutting face (not labeled) and a downward abutting face (not labeled) for blocking the corresponding locking latch 90 from moving backwardly and upwardly wherein the primary function of the locking latch 90 is to prohibit the plug cable connector 50 from backward/rearwardly moving by the forward abutting face, and the downward abutting face is to provide retention to have the locking latch 90 in position without moving during vibration. In this embodiment, the locking latch 90 is a bar extending in a transverse direction to comply with the locking shoulder which extends in the transverse direction between the pair of side walls 12. Notably, the locking latch 90 and the locking shoulder 20 may have other forms or dimensions as long as the locking shoulder 20 provides the forward abutting face to prevent the moveable locking latch from rearward moving, and optionally further provides the downward abutting face to prevent the movable locking latch 90 from upward moving to be released from the locking shoulder 20. In this embodiment, the locking latch 90 is moveable in the vertical direction in a deflective manner Notably, other type movements as translation or rotation may be other choices.

The plug cable connector 50 includes an insulative housing 52 with a mating slot 54, and two rows of contacts (not shown) are located by two sides of the mating slot 54. A terminal module 56 is assembled upon a rear side of the housing 52 via two hooks 51 inserted into the corresponding holes 53 of he housing 52, and includes a pair of bodies 58 assembled to each other via the post 581 and hole 582 structure, the contact tails (not shown) extending through the bodies 58 and positioned upon the corresponding platforms 58 for soldering with the corresponding differential pair wires 70. A pair of grounding plates 60 are attached upon the corresponding bodies 50 so as to connect to the corresponding grounding contacts (not shown) and the grounding/drain wires (not shown). Each grounding plate 60 has a main plate 601 depending on the platform 58, a set of contacting plates 602 arranged at intervals to contacting the corresponding grounding contacts, and a short plate 603 connecting front ends of the contacting plates 602. Said contacting plates 602 bend downwardly from a front end of the main plate 601 and then extend forwardly, said shorting plate 602 bend relative to the main plate in a perpendicular manner and forwardly depends on the body 58. Each main body 60 has a pair of ears 601 bending therefrom to overlap the corresponding ears 601 of another main body 60 so as to connecting the grounding plates 60 together. The platform 583 has a pair of cutouts 587 passing therethrough in the height direction for receiving the ears 601 of the grounding plate 60. The main plate 601 has a set of retaining plates 605 extending forwardly from the main plate 601 and inserting into corresponding retaining grooves 585 of the body 601. The platform 583 has a set of slits 586 formed on a surface thereof and corresponding to the retaining grooves 585.

An insulative block 62 is located behind the terminal modules 58 and includes a front cavity 64 to receive the rear portions of the terminal modules 56, and a pair of guiding lugs 66 on two lateral sides, and a plurality of passageways 68 through which the wires 70 extend, respectively. A pair of slots 72 are formed in the block 62 for receiving front portions of the coil springs 74 therein. A partition 76 is formed on the block 62 to separate the pair of coil springs 74 from each other. A pair of engagement grooves 75 are formed in two opposite lateral sides of the partition 76. An insulative spacer 78 is attached to the partition 76 via the engagement grooves 75. In this embodiment, the spacer 78 is adapted to be moveable relative to the block 62 along the front-to-back direction within a range regulated by the coil springs 74. The spacer 78 forms a pair of grooves 80 to receive the rear portion of the corresponding coil springs 74. The metallic shell spring 82 is attached upon the spacer 78 and forms a locking latch 90 thereon for releasable engagement with the locking shoulder 20. In this embodiment, the metallic shell spring 82 includes a pair of side bar (not labeled) extending along the front-to-back direction to connect the locking latch 90 at two opposite ends of the locking latch 90 in the transverse direction. Understandably, this floating effect of the spacer 78 is to absorb the impact/vibration applied upon the plug cable connector 50 for preventing the permanent damage to the plug cable connector 50 while stilling keeping the reliable retention to the locking station 10. An insulative casing 84 is overmolded upon the block 62 and the associated wires 70 wherein the guiding lugs 66 are transversely exposed to the exterior through said casing 84.

When the plug cable connector 50 is assembled to the locking station 10 from the back side of the locking station 10, the guiding lugs 66 moves along the guiding grooves 14 with the shell spring 82 being deflected by the top bar until the block 60 is stopped by the front upper bar 21 of the locking station 10 and the locking latch 90 of the shell spring 82 is engaged with the locking shoulder 20 of the top bar 18.

Figure 17:
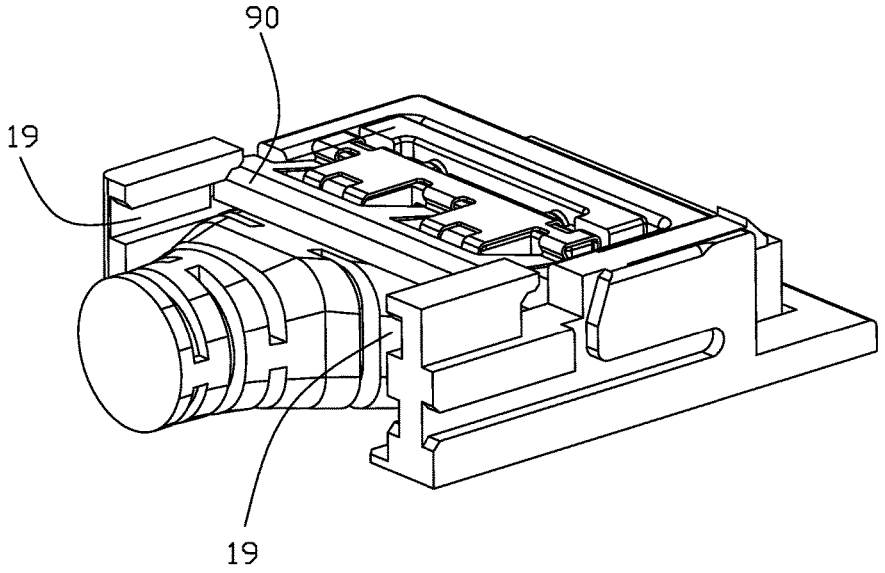
FIG. 17 is a perspective view of the electrical connector assembly according to a second embodiment of the invention wherein the plug cable connector is fully received and locked in the locking station.
Figure 18:
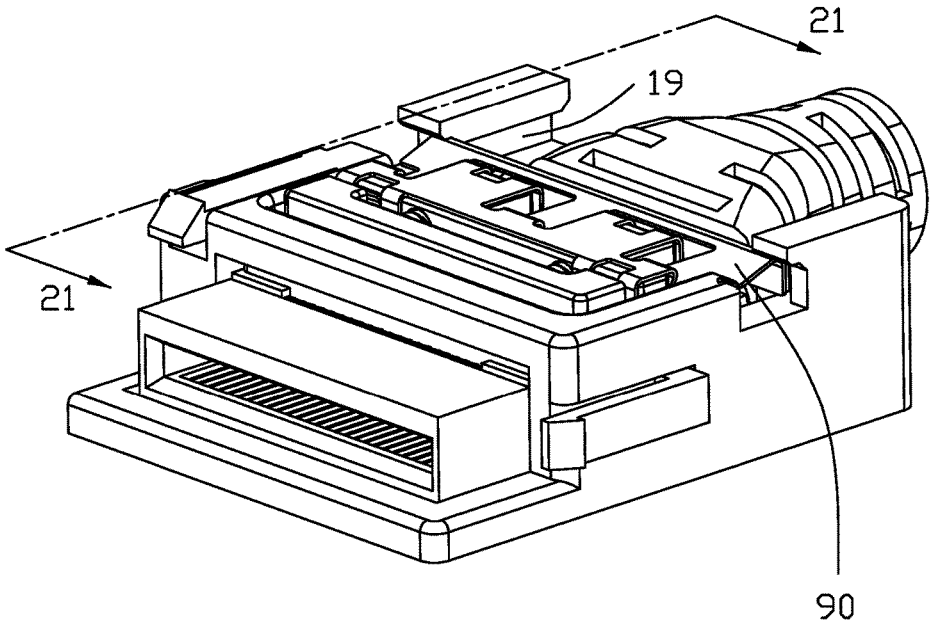
FIG. 18 is another perspective view of the electrical connector assembly of FIG. 17.
Figure 19:
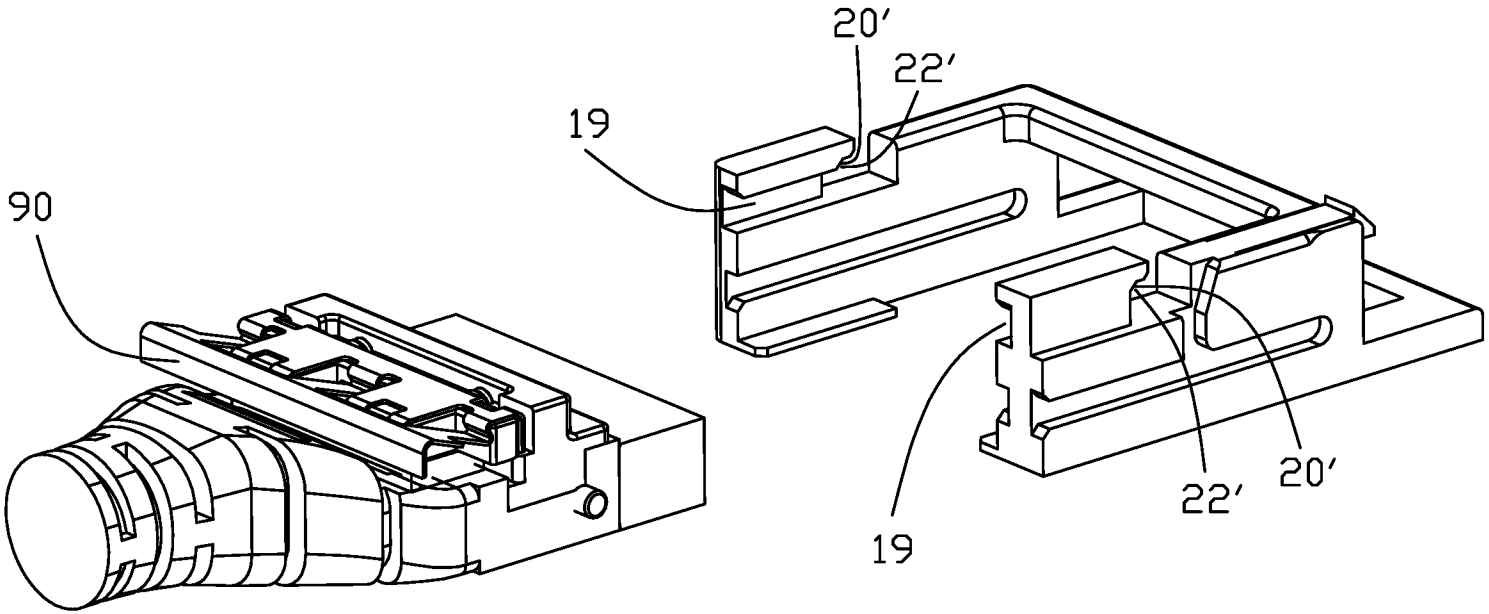
FIG. 19 is an exploded perspective view of the electrical connector assembly of FIG. 17.
Figure 20:
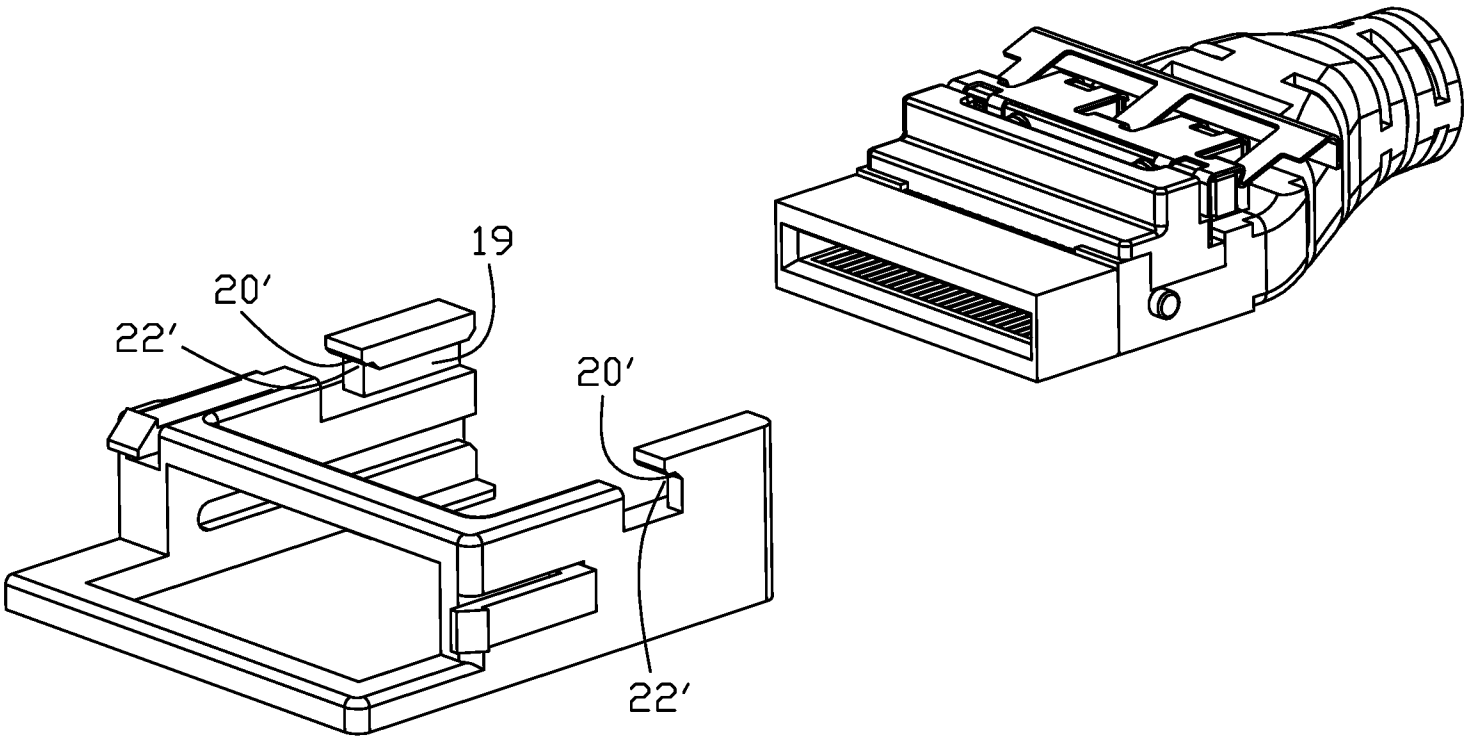
FIG. 20 is another exploded perspective view of the electrical connector assembly of FIG. 17.
Figure 21:
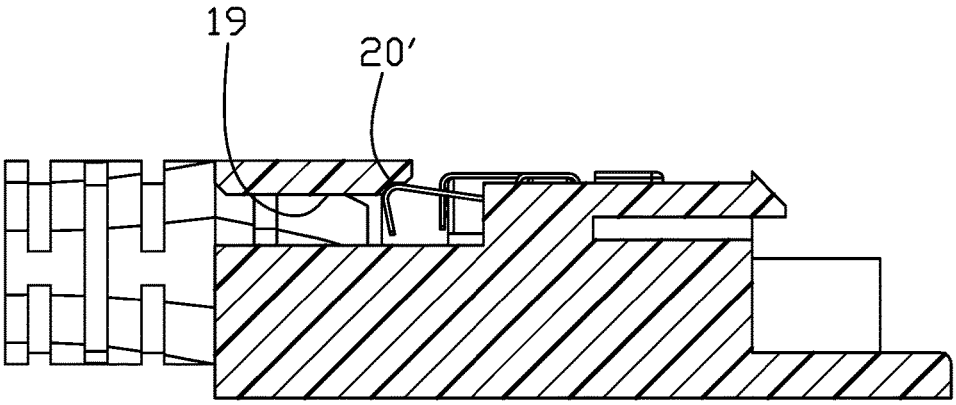
FIG. 21 is a cross-sectional view of the electrical connector assembly of FIG. 17 wherein the plug cable connector is fully received within and locked with regard to the locking station.
Figure 22:
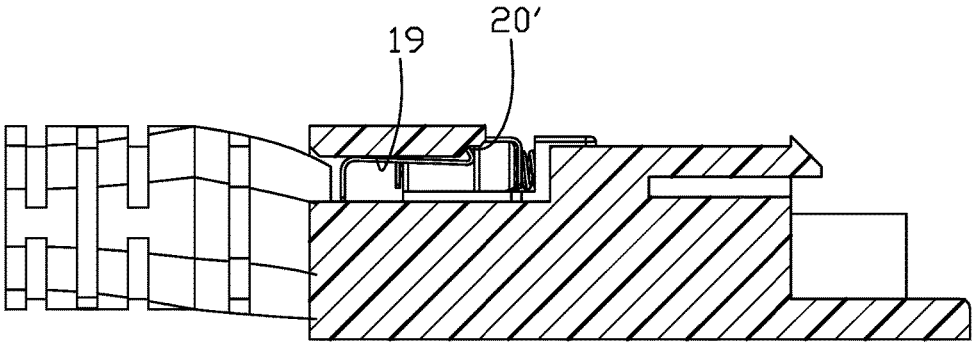
FIG. 22 is a cross-sectional view of the electrical connector assembly of FIG. 17 wherein the plug cable connector is partially received in the partially released from the locking station.

Referring to FIGS. 17-22 of the second embodiment, the different feature includes provision of another additional pair of grooves 19 are formed in an interior surfaces of the side walls 12 so as to guidably receive the two opposite lateral ends of the locking latch 90 therein for stabilizing movement of the shell spring 82 during insertion/withdrawal of the plug cable connector 50 with regard to the locking station 10. Notably, in the second embodiment the top bar in the first embodiment is removed, and the locking shoulders 20' are formed on two opposite side walls instead of along the top bar, each locking shoulder 20' forms a recess 22' on an underside thereof to receive the lateral ends of the locking latch 90. Understandably, the second embodiment allows the user to conveniently manually deflect the shell spring to insert the whole plug cable connector into the locking station with the locking latch engaged with the locking shoulder It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising: a locking station defining a receiving cavity, and a pair of side walls extending in a front-to-back direction and locating at two sides of the receiving cavity in a transverse direction perpendicular to said front-to-back direction; a plug cable connector being forwardly inserted into said receiving cavity and including a spring being deflectable; in a vertical direction perpendicular to both said front-to-back direction and said transverse direction; wherein said spring includes a pair of laterally extending offset ends; and each side wall defines a locking shoulder facing forwardly and pressing against said respective offset end downwardly, wherein said plug cable connector comprises an insulative housing defining a front mating slot, a terminal module assembled to the housing with contacts exposed in the mating cavity and respectively connected to corresponding wires of a cable, an insulative block assembled to the insulative housing with a plurality of passageways through which the corresponding wires extend along a front-to-back direction; and an insulative casing overmolding with said insulative housing and said insulative block; said spring is associated with the insulative block, wherein said spring is attached upon an insulative spacer which is attached to the insulative block in a floating manner along said front-to-back direction.

2. The electrical connector assembly as claimed in claim 1, wherein said locking shoulder has a recess formed on an underside thereof to receive the respective offset end.

3. The electrical connector assembly as claimed in claim 1, wherein said spring slopes backwardly and upwardly relative to the front-to-back direction.

4. The electrical connector assembly as claimed in claim 1, wherein a compression spring is located between the insulative spacer and the insulative block to provide floating between the spacer and the block in the front-to-back direction.

5. The electrical connector assembly as claimed in claim 1, wherein said terminal module further includes a body to support the contacts thereon, and said body includes a hook to be engaged within a hole of the housing; said terminal module includes on the body a grounding plate to which grounding contacts of said contacts and drain wires of the cable are connected.

6. An electrical connector assembly comprising: a locking station forming a receiving cavity and a locking shoulder at an upper side of the receiving cavity; a plug cable connector being forwardly inserted into said receiving cavity and including a spring extending backwardly; wherein said spring has a locking latch for releasable engagement with the locking shoulder, and said locking shoulder presses against said locking latch downwardly, wherein said plug cable connector includes an insulative housing with a mating slot, a terminal module assembled behind the housing with two rows of contacts locating by two sides of the mating slot and respectively connected to corresponding wires of a cable, and an insulative block assembled to the housing; said insulative Mock protrudes upwardly beyond the receiving cavity; and said spring attaches to the insulative block, wherein said terminal module includes a pair of grounding plates on which mounding contacts of said contacts are connected and drain wires of the cable are connected; and said terminal module includes a pair of insulative bodies attached to each other.

7. The electrical connector assembly as claimed in claim 6, wherein one of the locking station and the insulative block forms a pair of guiding grooves, and the other forms a pair of guiding lugs receiveably moveable along the guiding grooves.

8. The electrical connector assembly as claimed in claim 6, wherein said locking shoulder has a recess formed on an underside thereof to receive the locking latch.

9. The electrical connector assembly as claimed in claim 6, wherein said locking shoulder protrudes forwardly and faces the plug cable connector at the back, said spring slopes upwardly to be pressed against by said locking shoulder both forwardly and downwardly.

10. The electrical connector assembly as claimed in claim 6, wherein said locking station includes a pair of side walls each of which the locking shoulder is formed thereon; and said locking latch includes a pair of laterally extending offset ends for engagement with the locking shoulder on the pair of side walls.

11. An electrical connector assembly comprising: a locking station including a pair of side walls to define a passage there between in a transverse direction, said locking station further forming a forward abutting face and a downward abutting face; and a plug forwardly inserted into the passage in a front-to-back direction perpendicular to said transverse direction, and equipped with a moveable locking latch moveable relative to the locking station in a vertical direction perpendicular to both said transverse direction and said front-to-back direction; wherein during mating, the movable locking latch is prevented from moving rearwardly by the forward abutting face and is prevented from moving upwardly by the downward abutting face, wherein the locking station forms a locking shoulder on which both the forward abutting face and the downward abutting face are formed, wherein said locking latch includes a pair of side bars with a transverse bar linked at least to one of the pair of side bars and extending in the transverse direction around the locking shoulder.

12. The electrical connector assembly as claimed in claim 11, wherein said locking latch is locked by the locking shoulder in both the front-to-back direction and the vertical direct on.

13. The electrical connector assembly as claimed in claim 12, wherein said transverse bar has to opposite ends in the transverse direction respectively linked to said pair of side bars.

14. The electrical connector assembly as claimed in claim 12, wherein said transverse bar is essentially hidden from an exterior viewed from a rear side of the locking station.

* * * * *